US011976841B2

(12) United States Patent
Lanciaux

(10) Patent No.: US 11,976,841 B2
(45) Date of Patent: May 7, 2024

(54) INSULATION FASTENING SYSTEM

(71) Applicant: Fran Lanciaux, Grand Rapids, OH (US)

(72) Inventor: Fran Lanciaux, Grand Rapids, OH (US)

( * ) Notice: Subject to any disclaimer, the term of this patent is extended or adjusted under 35 U.S.C. 154(b) by 461 days.

(21) Appl. No.: 17/003,052

(22) Filed: Aug. 26, 2020

(65) Prior Publication Data

US 2022/0065490 A1 Mar. 3, 2022

(51) Int. Cl.
*F24F 13/02* (2006.01)

(52) U.S. Cl.
CPC ..... *F24F 13/0263* (2013.01); *F24F 13/0245* (2013.01)

(58) Field of Classification Search
CPC ..... F24F 13/0263; F24F 13/0245
USPC ..... 138/149
See application file for complete search history.

(56) References Cited

U.S. PATENT DOCUMENTS 5,918,644 A * 7/1999 Haack ..... F24F 13/0281 138/146
5,944,060 A * 8/1999 MacKay ..... F24F 13/0209 138/140
6,298,555 B1 * 10/2001 Vincenti ..... F24F 13/0263 29/525.01
6,357,196 B1 * 3/2002 McCombs ..... E04C 3/28 138/167
6,935,379 B1 * 8/2005 Buchanan, Sr. ..... F16L 59/026 138/167
7,559,343 B1 * 7/2009 Vujic ..... F16L 59/12 220/592.2
8,186,387 B2 * 5/2012 Wadsworth ..... F16L 59/029 138/143
8,663,791 B2 * 3/2014 Day ..... B32B 3/18 428/317.1
2002/0029816 A1 * 3/2002 Sproule, III ..... F16L 59/021 138/158
2004/0016470 A1 * 1/2004 Whitty ..... F16L 59/123 138/110
2010/0307628 A1 * 12/2010 Rowan ..... F16L 9/02 138/149
2019/0309981 A1 * 10/2019 Nolin ..... F24F 13/0281
2020/0049366 A1 * 2/2020 Harris ..... F24F 13/0245

* cited by examiner

*Primary Examiner* — David R Deal
(74) *Attorney, Agent, or Firm* — C. Fred Charpie, III; Ward Law Office LLC

(57) ABSTRACT

A fastening channel configured for use in insulating uninsulated ductwork is provided. The fastening channel includes a plurality of members forming one or more cavities. The cavities are configured to receive sections of an insulation envelope. The insulation envelope is formed from a duct board. The duct board is formed from a thermoplastic polymer sheet, a plurality of facing sheets and a layer of foam insulation. A plurality of angled splines extends from the plurality of members and form a plurality of clamps. The clamps are configured to engage one of the facing sheets such as the maintain the insulation envelope in place.

5 Claims, 16 Drawing Sheets

INSULATION FASTENING SYSTEM

BACKGROUND

Commercial and residential buildings have thermal distribution systems, many of which are air-based that distribute air through ductworks. The thermal distribution systems are typically formed by ductwork sections connected together and formed by sheet metal. In many instances, the thermal distribution systems are positioned on a roof of a building or on exterior building surfaces. The ductwork sections form hollow passages and flanges are typically formed at the ends of the sections and used to connect adjacent sections together.

In the event the thermal distribution ductwork systems are uninsulated, leakage and conduction-loss problems can occur. The extent of the duct-related thermal losses in uninsulated thermal distribution ductwork systems can depend on the location of the ductwork. In certain instances, large thermal losses can occur when significant portions of the uninsulated ductworks are located outside the building envelope.

Leakage, conduction losses, direct solar radiation effects and solar reflection all affect the magnitude of thermal loss in uninsulated ductworks. Differences in the lengths of exterior uninsulated ductworks also affect a distribution system's energy efficiency, as well as the temperature of air delivered to interior spaces at the registers. When long duct runs are exposed to sunlight and high outdoor temperatures on roofs, the supply air can experience a significant configuration temperature rise before reaching the registers during periods of demand for interior cooling. This configuration can have a direct impact on interior thermal comfort conditions and can cause uneven temperature distribution within the building.

It would be advantageous if uninsulated ductworks could be more easily insulated.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the insulation fastening system.

The above objects as well as other objects not specifically enumerated are achieved by a fastening channel configured for use in insulating uninsulated ductwork. The fastening channel includes a plurality of members forming one or more cavities. The cavities are configured to receive sections of an insulation envelope. The insulation envelope is formed from a duct board. The duct board is formed from a thermoplastic polymer sheet, a plurality of facing sheets and a layer of foam insulation. A plurality of angled splines extends from the plurality of members and form a plurality of clamps. The clamps are configured to engage one of the facing sheets such as the maintain the insulation envelope in place.

The above objects as well as other objects not specifically enumerated are also achieved by an insulation assembly. The insulation assembly includes an insulation envelope configured to form a cavity. The cavity is configured to receive a section of uninsulated ductwork. The insulation envelope is formed from a duct board. The duct board is formed from a thermoplastic polymer sheet, a plurality of facing sheets and a layer of foam insulation. The insulation envelope forms an opening. A fastening channel is positioned within the opening of the insulation envelope and has a plurality of members forming one or more cavities. The cavities are configured to receive sections of an insulation envelope. The fastening channel also has a plurality of angled splines extending from the plurality of members and form a plurality of clamps. The clamps are configured to engage one of the facing sheets such as the maintain the insulation envelope in place.

The above objects as well as other objects not specifically enumerated are also achieved by a method of insulating uninsulated ductwork. The method includes the steps of forming an insulation envelope having a cavity, the cavity configured to receive a section of uninsulated ductwork, the insulation envelope formed from a duct board, the duct board formed from a thermoplastic polymer sheet, a plurality of facing sheets and a layer of foam insulation, the insulation envelope forming an opening and positioning a fastening channel within the opening of the insulation envelope, the fastening channel having a plurality of members forming one or more cavities, the cavities configured to receive sections of a insulation envelope, the fastening channel also having a plurality of angled splines extending from the plurality of members and forming a plurality of clamps, the clamps configured to engage one of the facing sheets such as the maintain the insulation envelope in place.

Various objects and advantages of the insulation fastening system will become apparent to those skilled in the art from the following detailed description, when read in light of the accompanying drawings.

DETAILED DESCRIPTION

The insulation fastening system will now be described with occasional reference to specific embodiments. The insulation fastening system may, however, be embodied in different forms and should not be construed as limited to the embodiments set forth herein. Rather, these embodiments are provided so that this disclosure will be thorough and complete and will fully convey the scope of the insulation fastening system.

Unless otherwise defined, all technical and scientific terms used herein have the same meaning as commonly understood by one of ordinary skill in the art to which the insulation fastening system belongs. The terminology used in the description of the insulation fastening system herein is for describing particular embodiments only and is not intended to be limiting of the insulation fastening system. As used in the description of the insulation fastening system and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the insulation fastening system. Notwithstanding that the numerical ranges and parameters setting forth the broad scope of the insulation fastening system are approximations, the numerical values set forth in the specific examples are reported as precisely as possible. Any numerical values, however, inherently contain certain errors necessarily resulting from error found in their respective measurements.

The description and figures disclose a novel insulation fastening system. Generally, the novel insulation fastening system incorporate an insulation assembly having a folded and/or shaped insulation envelope. The folded insulation envelope forms a cavity configured to receive and encapsulate a section of uninsulated ductwork. The folded insulation envelope is maintained in position by a fastening channel. The fastening channel includes one or more angled splines configured to form a clamping action on the folded insulation envelope. The encapsulation of the uninsulated ductwork can be accomplished without disruption of the uninsulated ductwork and without disruption of the air flowing within the uninsulated ductwork.

The term "ductwork", as used herein, is defined to mean any structure, device or mechanism used in heating, ventilation, and air conditioning to deliver and remove air.

Figure 1:
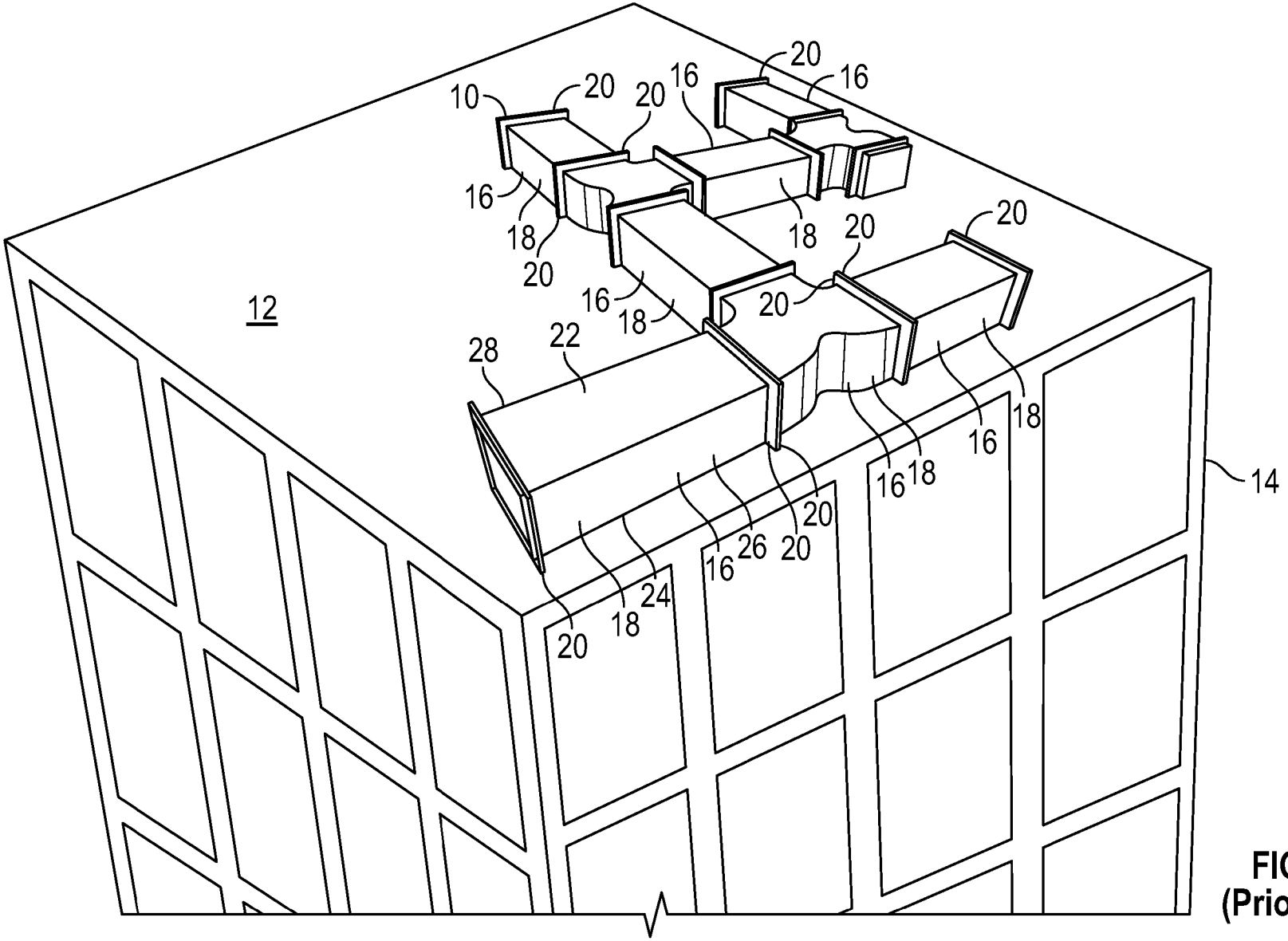
FIG. 1 (Prior Art)
FIG. 1 is a perspective view of a first embodiment of a conventional uninsulated ductwork.

Referring now to FIG. 1, a first embodiment of an uninsulated ductwork (hereafter "ductwork") is shown generally at 10. The ductwork 10 is configured as an air-based, thermal distribution system that is conventional in the art. In the illustrated embodiment, the ductwork 10 is positioned on a roof 12 of a building 14, although such is not necessary. In certain instances, the ductwork 10 can be newly installed. In other instances, the ductwork 10 may have been installed years ago. The ductwork 10 includes a plurality of hollow, rectangularly-shaped sections 16, each bounded by a rectangular or square circumferential covering 18. Flanges 20 are typically formed at the ends of the sections 16 and used to connect adjacent sections 16 together.

Referring again to FIG. 1, each of the sections 16 has an upper face 22, an opposing lower face 24, a first side face 26 and a second side face 28. Each of the faces 22, 24, 26 and 28 will be discussed in more detail below.

Figure 2:
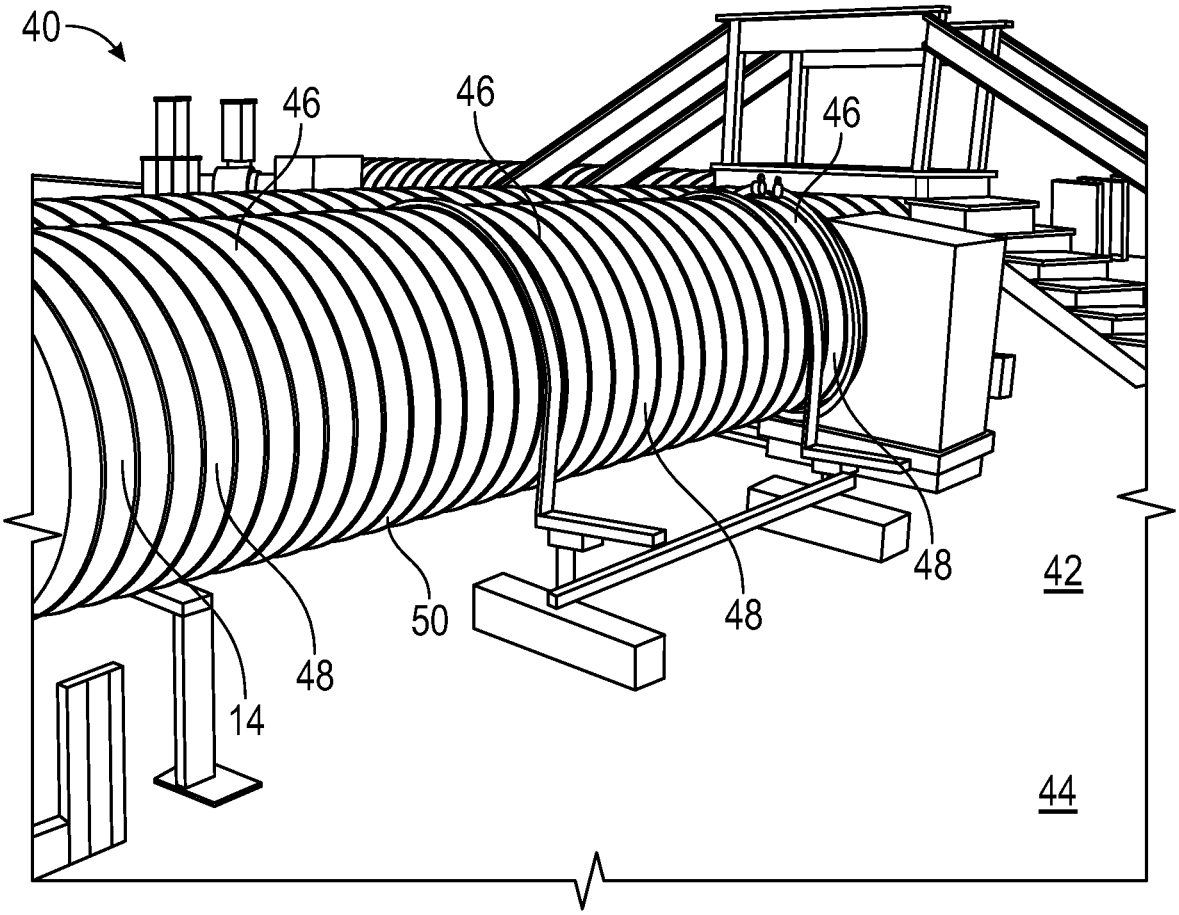
FIG. 2 (Prior Art)
FIG. 2 is a perspective view of a second embodiment of a conventional uninsulated ductwork.

Referring now to FIG. 2, a second embodiment of an uninsulated ductwork is shown generally at 40. The ductwork 40 is also configured as an air-based, thermal distribution system that is conventional in the art. In the illustrated embodiment, the ductwork 40 is positioned on a roof 42 of a building 44, although such is not necessary. In certain instances, the ductwork 40 can be newly installed. In other instances, the ductwork 40 may have been installed years ago. The ductwork 40 includes a plurality of hollow, circularly shaped sections 46, each bounded by a circular circumferential covering 48. The circumferential coverings 48 have an outer face 50, which will be discussed in more detail below.

Figure 3:
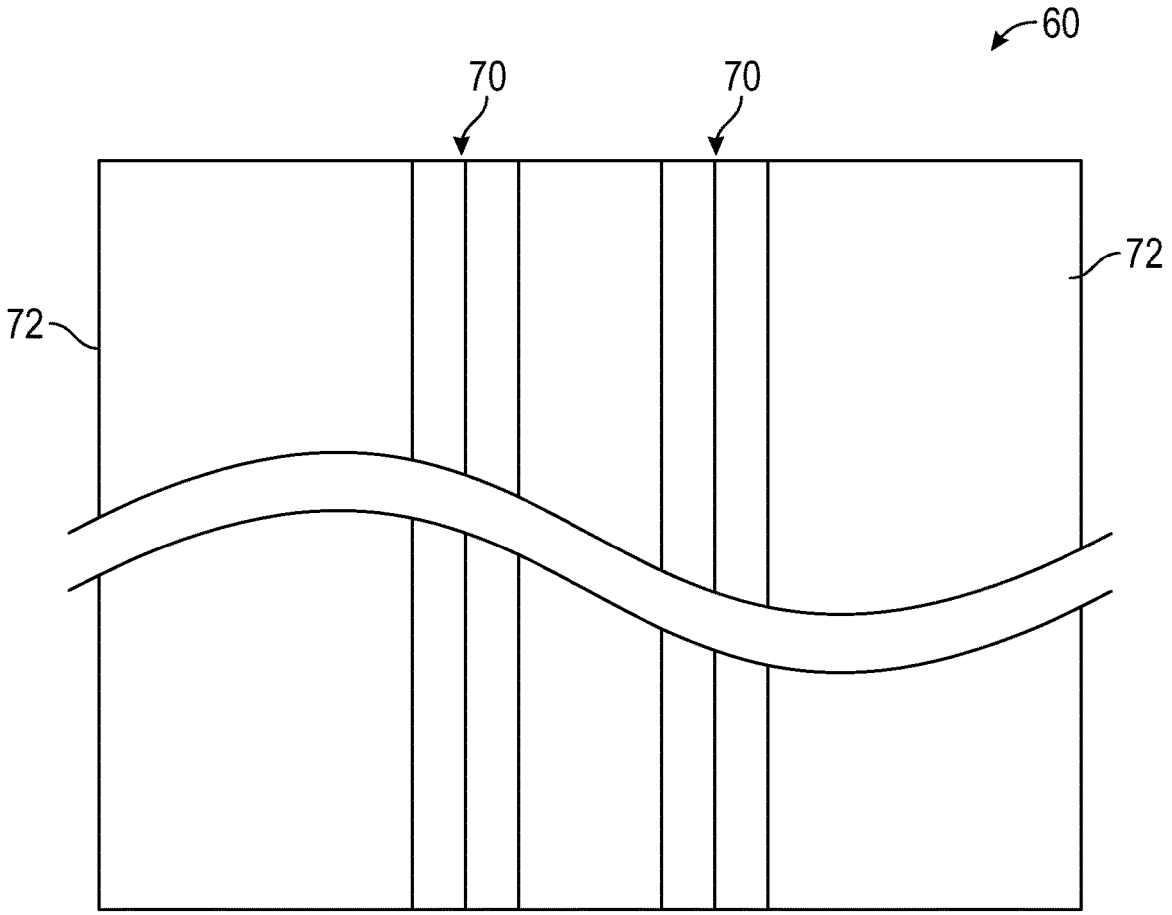
FIG. 3 is a plan view of a first embodiment of a duct board having three panels defined by two V-shaped grooves formed in the duct board for forming a three-sided insulation envelope according to the invention.
Figure 4:
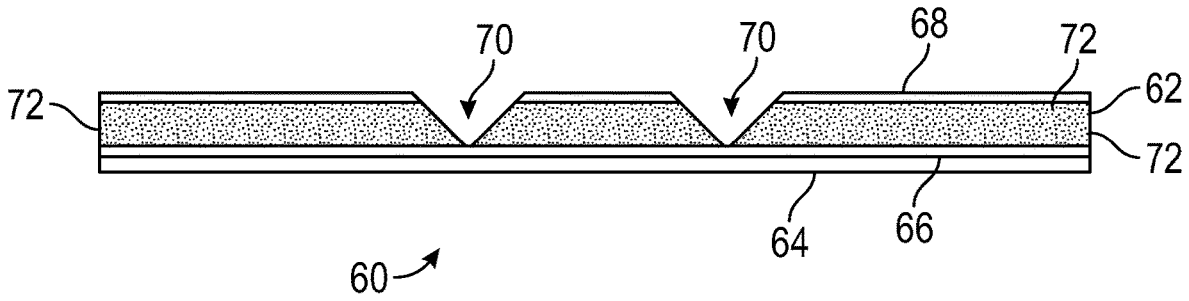
FIG. 4 in an end view of the duct board of FIG. 3.

Referring now to FIGS. 3 and 4, duct board according to the present invention is indicated generally at 60. The duct board 60 is a laminate comprising more than one material. The duct board 60 comprises a layer of foam insulation panel 62 and a sheet of thermoplastic polymer 64. The thermoplastic polymer sheet 64 may have any one of a range of thicknesses. For example, a range of 0.3 mm to 2.0 mm is suitable. A thickness of 1.0 mm is suitable for use with the foam panels specifically disclosed and described below.

Referring again to FIGS. 3 and 4, the foam insulation panel 62 may be faced with opposing facing sheets 66 and 68. The facing sheets 66, 68 can be formed from scrimmed aluminum foil or any other acceptable facing material. Excellent results have been obtained where the foam insulation panel 62 is one that is available from Kingspan under the trademark KoolDuct®. It is a rigid phenolic insulation, panel that has a rigid phenolic insulation core with zero Ozone Depletion Potential (ODP), autohesively bonded on both sides to a 1 mil low vapor permeability aluminum foil facing reinforced with a 0.2" glass scrim. KoolDuct rigid phenolic insulation panels are available in thicknesses of ⅞", 1 3/16" and 1 5/16". KoolDuct panels are approximately four feet wide and come in lengths of ten feet and thirteen feet. It has a high R-value, excellent fire and heat resistance properties, and it is a closed cell foam. KoolDuct is distributed with foil facing layers. While the foam insulation panel 62 has been described above as being formed from KoolDuct®, it should be appreciated that other suitable foam insulation panels can be used.

Referring again to FIGS. 3 and 4, the thermoplastic polymer sheet 64 is formed from a thermoplastic material and good results have been obtained using PVC thermoplastic sheet material. In a finished duct, the thermoplastic polymer sheet 64 will be on the outside and so the material should be selected for this type of service. In certain instances, the thermoplastic polymer sheet 64 can contain additives to prolong its service life. As one non-limiting example, lithium oxide may be added to improve resistance to degradation caused by ultraviolet radiation. The thermoplastic polymer sheet 64 is securely bonded to the foam insulation panel 62. Excellent results have been obtained with polyurethane adhesive systems. In any case, a strong and secure bond is required between the foam insulation panel 62 and the thermoplastic polymer sheet 64.

While the duct board 60 has been shown in FIGS. 3 and 4 and described above as having a layer of foam insulation panel 62 adhered to a sheet of thermoplastic polymer 64, it is contemplated that in other embodiments, other suitable materials can be used in lieu of the thermoplastic polymer 64. Non-limiting examples of suitable materials include metallic materials, metallic alloy-based materials, carbon-fiber materials and the like.

Referring again to FIGS. 3 and 4, a plurality of V-shaped grooves, indicated at 70, have been formed in the duct board 60 to form faces that form an angle of approximately 90 degrees. Edges 72 of the duct board 60 have a square cross-sectional shape, that is, the edges 72 form an angle of approximately 90 degrees.

Figure 5:
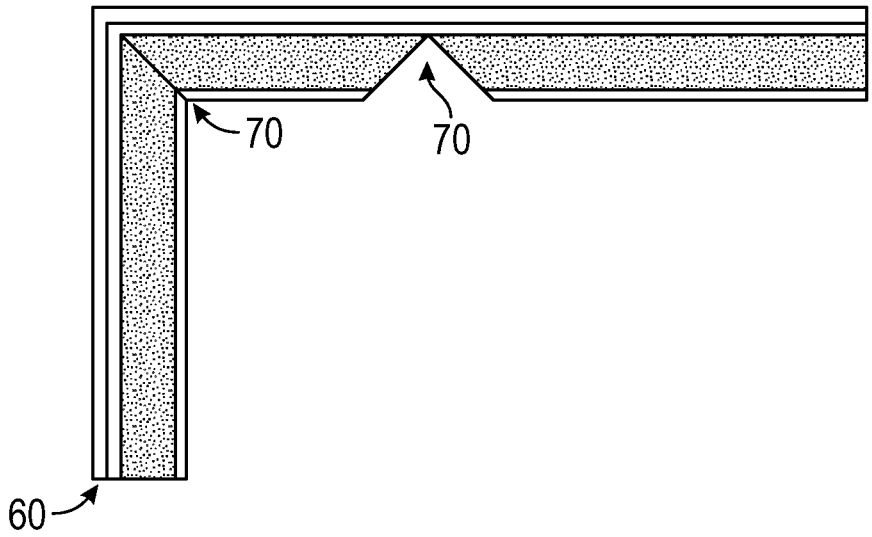
FIG. 5 is an end view of the duct board of FIG. 3 after the duct board has been folded along a first V-shaped groove.
Figure 6:
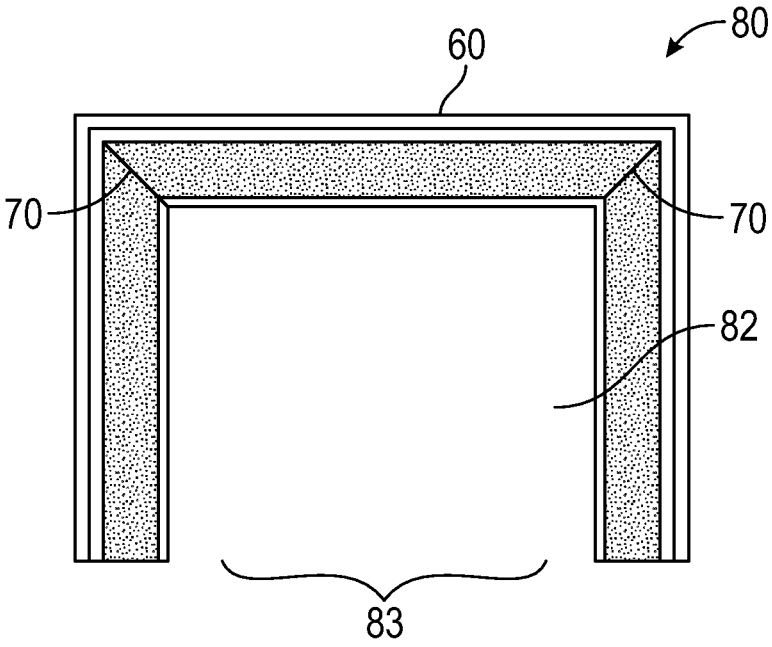
FIG. 6 is an end view of the duct board of FIG. 5 after the duct board has been folded along a second V-shaped groove.

Referring now to FIGS. 5-10, the method of forming the duct board 60 into an insulating assembly will now be discussed. Referring now to FIGS. 5 and 6 in first and second steps, the duct board 60 is folded twice along the V-shaped grooves 70 to form a three-sided insulation envelope 80. The three-sided insulation envelope 80 forms a cavity 82 therewithin and an opening 83. The cavity 82 has a rectangular or square cross-sectional shape corresponding to the rectangular or square cross-sectional shape of an intended ductwork to be insulated. The cavity 82 has a length and height corresponding to length and height of the intended ductwork.

Figure 7:
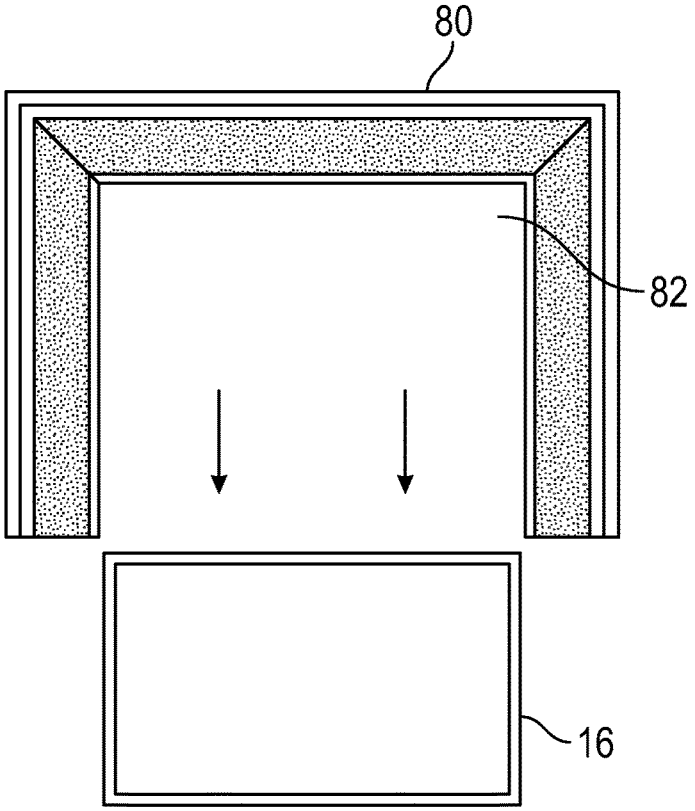
FIG. 7 is an end view of the duct board of FIG. 6 illustrating a cavity within the duct board configured to receive a section of uninsulated ductwork.
Figure 8:
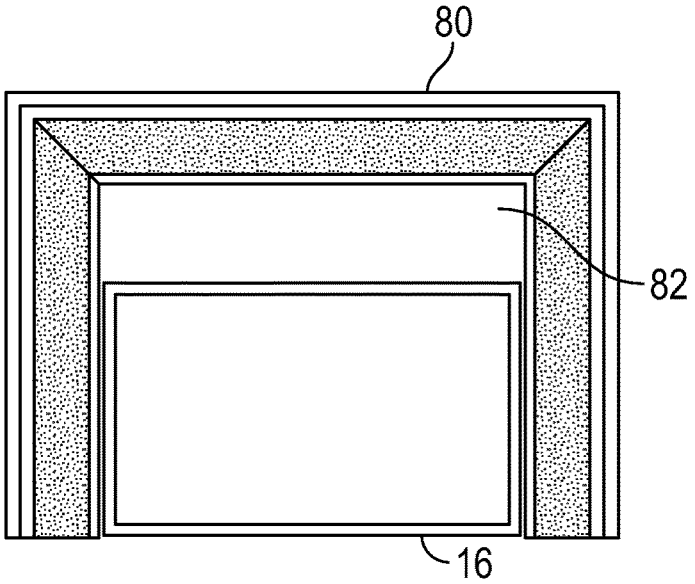
FIG. 8 is an end view of the duct board of FIG. 6 illustrating a section of uninsulated ductwork partially seated with the cavity.

Referring now to FIGS. 7 and 8 in the next steps, the three-sided insulation envelope 80 is installed over a section 16 of uninsulated ductwork by sliding the three-sided insulation envelope 80 over the section 16 in a manner such that the section 16 is positioned within the cavity 82.

Figure 9:
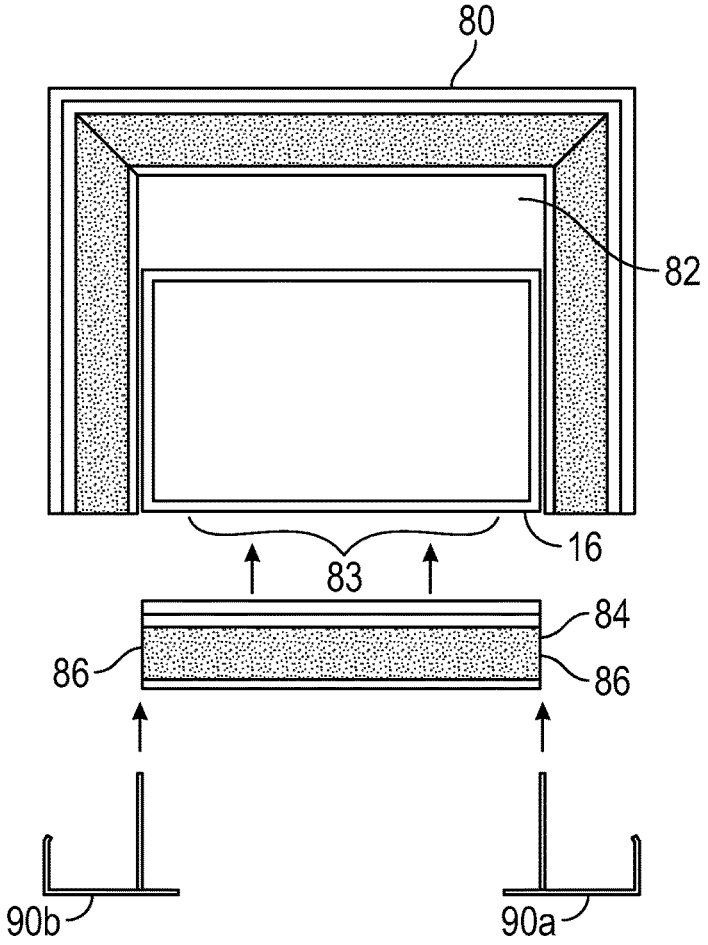
FIG. 9 is an end view of the duct board of FIG. 6 illustrating an insulation cap positioned to cover the uninsulated ductwork.
Figure 10:
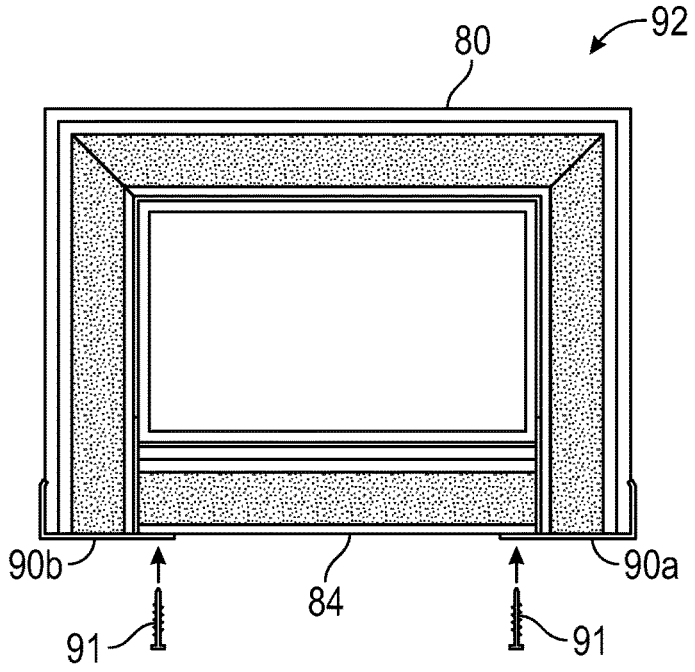
FIG. 10 is an end view of an insulation assembly having a section of uninsulated ductwork seated within the cavity formed by the duct board of FIG. 6 and an insulation cap sealing an opening in the duct board.

Referring now to FIGS. 9 and 10 in the next steps, an insulation cap 84, also having edges 86 with square cross-sectional shapes, is inserted into the opening 83 in a manner such that the edges 86 of the insulation cap 84 seat against portions of the three-sided insulation envelope 80 and cover the opening 83. The insulation cap 84 is formed from the same material as is used to form the duct board 60. In the next steps, a plurality of fastening channels 90*a*, 90*b* are used to attach the insulation cap 84 to the three-sided insulation envelope 80. Optionally, a plurality of fasteners 91 can be used to secure the plurality of fastening channels 90*a*, 90*b* to the insulation cap 84. In the illustrated embodiment, the fasteners 91 have the form of sheet metal screws. In alternate embodiments, the fasteners 91 can have other forms sufficient to secure the plurality of fastening channels 90*a*, 90*b* to the insulation cap 84. Taken together, the three-sided insulation envelope 80, the insulation cap 84, the plurality of fastening channels 90*a*, 90*b* and the plurality of optional fasteners 91 form an insulation assembly 92, as shown in FIG. 10.

Figure 11:
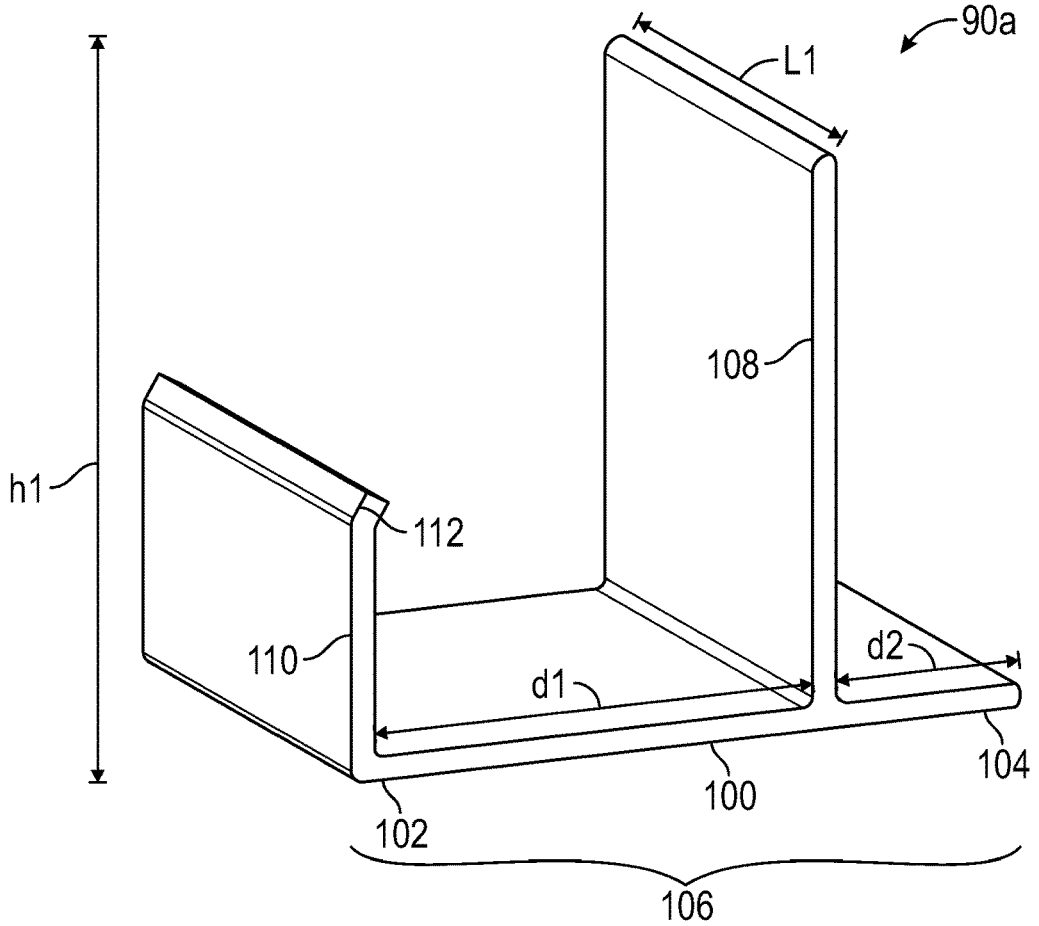
FIG. 11 is an end view of a first embodiment of a fastening channel in accordance with the invention.

Referring now to FIG. 11, the fastening channel 90*a* is illustrated. The fastening channel 90*a* is representative of the fastening channel 90*b*. The fastening channel is configured to attach the insulation cap 84 to the three-sided insulation envelope 80. The fastening channel 90*a* includes a base member 100 having a first end 102, an opposing second end 104 and a middle section 106 extending therebetween. A first radial spline 108 extends from the middle section 106 and a second radial spline 110 extends from the first end 102 in the same direction as the first radial spline 108. An angled spline 112 extends from the second radial spline 110 in a direction toward the first radial spline 108.

Referring again to FIG. 11, a distance d1 is formed between the first and second radial splines 108, 110. A distance d2 is formed between the first radial spline 108 and the second end 104 of the base member 100. The first radial spline 108 has a height h1. The distances d1, d2 and the height h1 will be discussed in more detail below.

Figure 13:
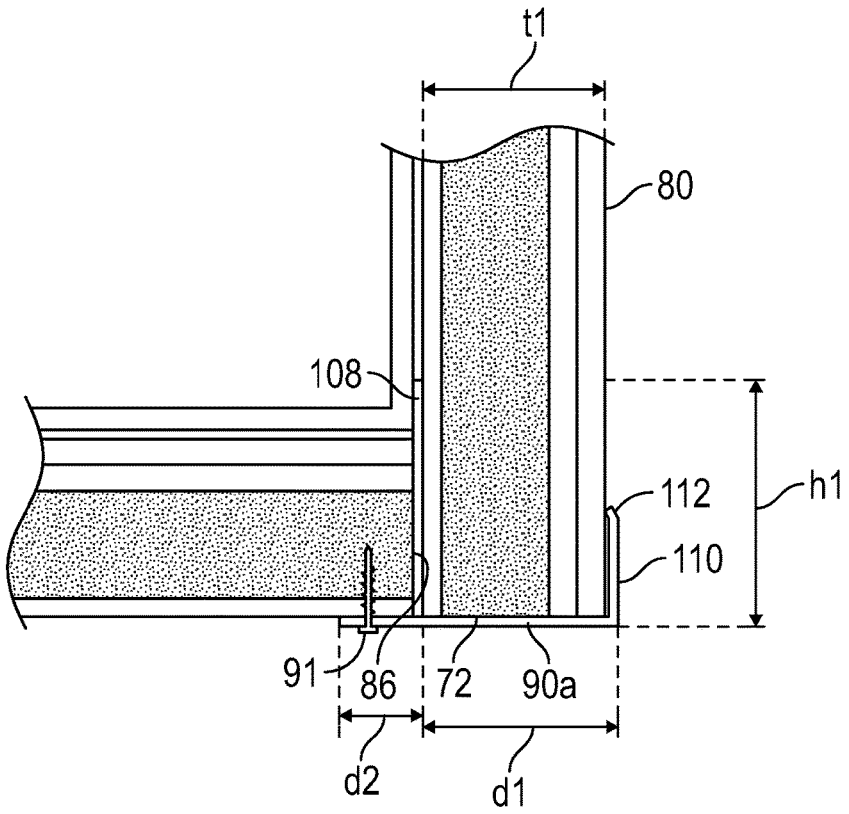
FIG. 13 is an end view of the fastening channel of FIG. 11 shown in an installed orientation.

Referring now to FIG. 13, the fastening channel 90*a* is shown in an installed orientation with the first radial spline 108 extending into a gap formed between the edge 86 of the insulation cap 84 and an inside surface of the three-sided envelope 80. In the installed orientation, the base member 100 seats against an exterior surface of the insulation cap 84 and also against the edge 72 of the three-sided envelope 80. The second radial spline 110 extends along a portion of the three-sided envelope 80. In this position, the angled spline 112 presses against an exterior surface of the three-sided envelope 80, thereby providing a resilient clamping action that attaches and maintains the three-sided envelope 80, the insulation cap 84 and the fastening channel 90*a* in place.

Referring again to FIG. 13, the distance d1 formed between the first and second radial splines 108, 110 approximates the thickness t1 of one of the sides of the three-sided envelope 80, thereby facilitating the resilient clamping action of the angled spline 112. The distance d2 formed between the first radial spline 108 and the second end 104 of the base member 100 extends a distance along an exterior surface of the insulation cap 84 in a manner such as to retain the insulation cap 84 in a seated position against the section 16 and seal the gap formed between the edge 86 of the insulation cap 84 and an inside surface of one of the sides of the three-sided envelope 80. The height h1 of the first radial spline 108 is configured to extend a sufficient distance into the gap formed between the edge 86 of the insulation cap 84 and an inside surface of one of the sides of the three-sided envelope 80, thereby fixing the fastening channel 90*a* in place as a result of the resilient clamping action of the angled spline 112.

Referring again to the embodiment illustrated in FIG. 11, the fastening channel 90*a* has the form of a unitary, one-piece structure and is formed from a polymeric-based, weather-resistant material. In certain instances, the fastening channel 90*a* can contain additives to prolong its service life. As one non-limiting example, lithium oxide may be added to improve resistance to degradation caused by ultraviolet radiation.

Figure 12:
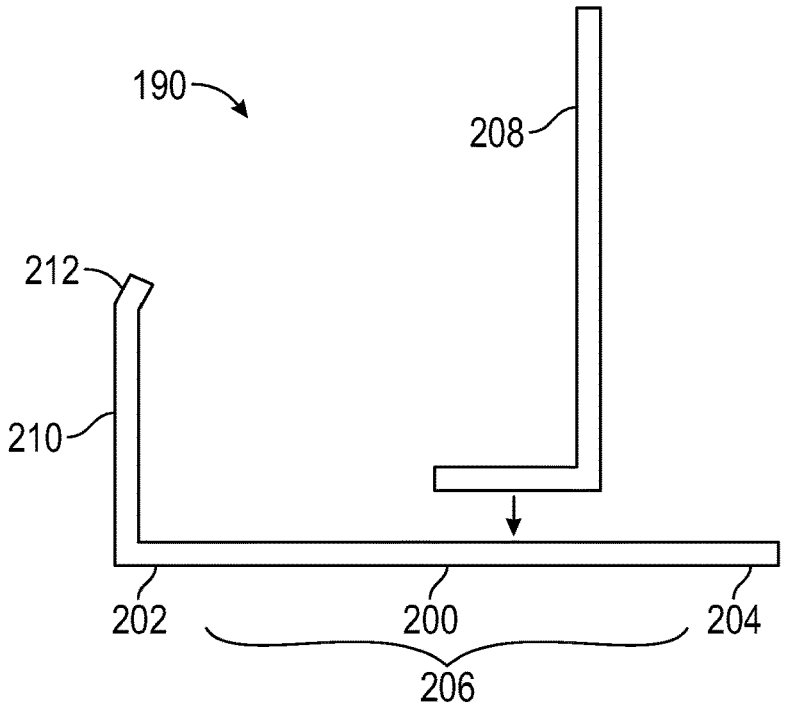
FIG. 12 is an end view of a second embodiment of a fastening channel in accordance with the invention.

While the fastening channel 90*a* is shown in FIGS. 9-11 and described above as a unitary, one-piece structure, it should be appreciated that in other embodiments the fastening channel can have other forms. Referring now to FIG. 12, a second embodiment of a fastening channel is shown generally at 190. The fastening channel 190 includes a base member 200 and a first radial member 208. The base member 200 has a first end 202, an opposing second end 204 and a middle section 206 extending therebetween. The first radial member 208 is connected to the middle section 206. A second radial member 210 extends from the first end 202 in the same direction as the first radial member 208. An angled spline 212 extends from the second radial member 210 in a direction toward the first radial member 208. The fastening channel 190 is installed in the same manner as the fastening channels 90*a*, 90*b* described above.

Figure 14:
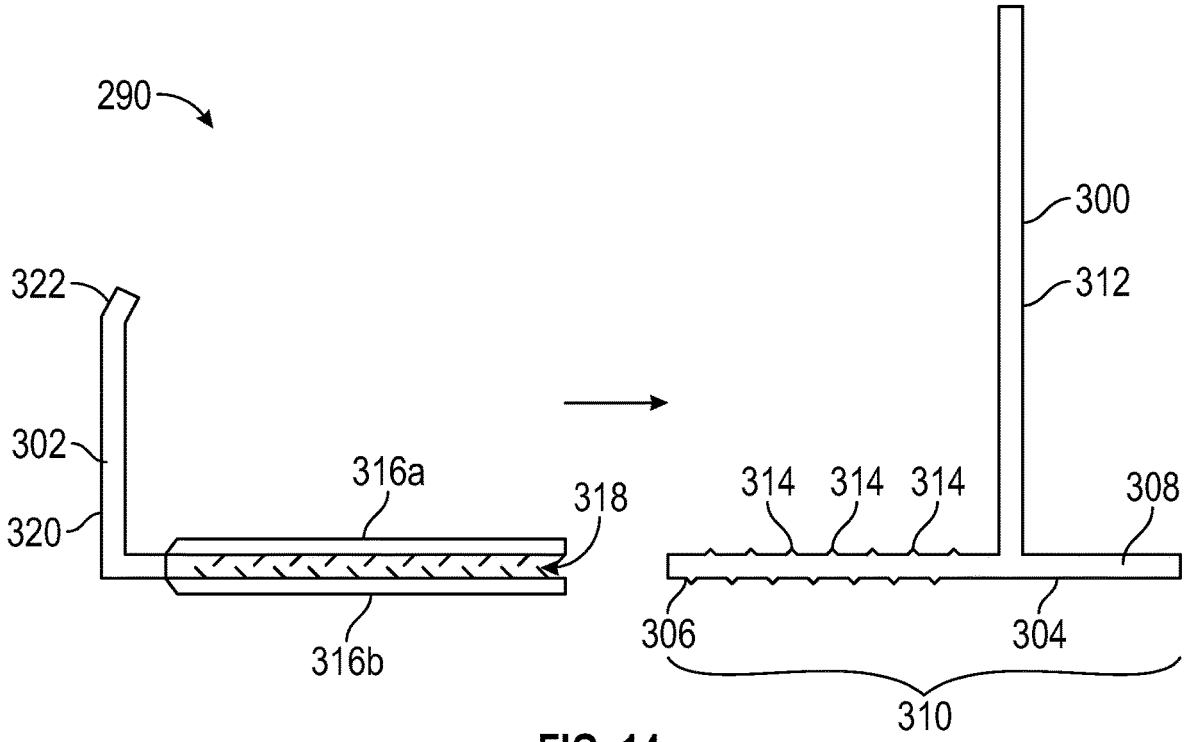
FIG. 14 is an exploded end view of a first embodiment of an adjustable fastening channel in accordance with the invention.
Figure 15:
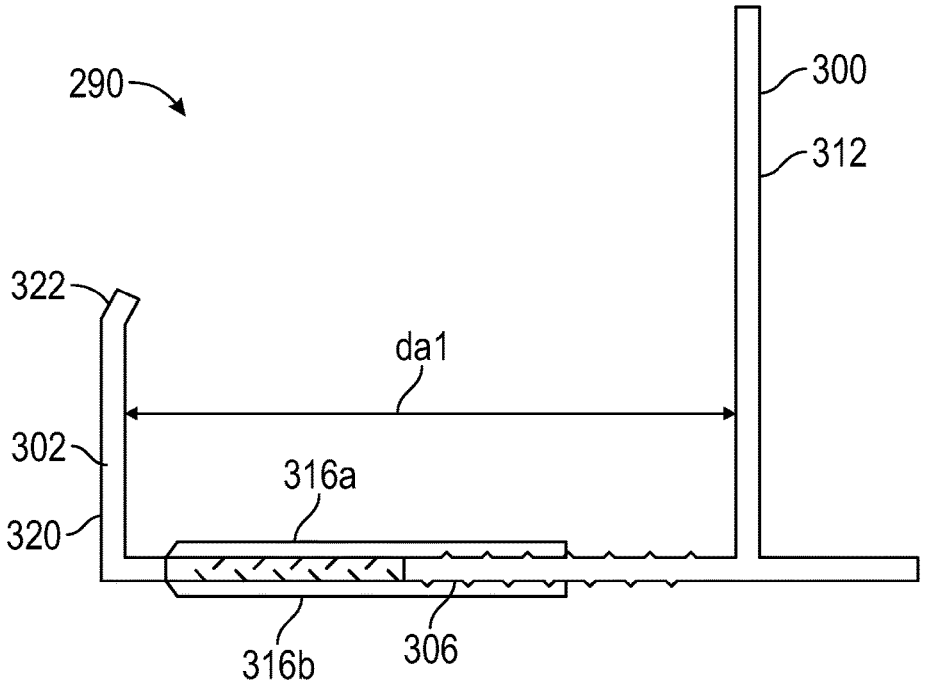
FIG. 15 is an assembled end view of the adjustable fastening channel of FIG. 14.

While the fastening channel 90*a* shown in FIG. 11 forms a fixed distance d1 between the first and second radial splines 108, 110, it is contemplated that in other embodiments portions of the fastening channel can be adjustable to accommodate sides of the three-sided envelope having different thicknesses. Referring now to FIGS. 14 and 15, another embodiment of a fastening channel is shown generally at 290. The fastening channel 290 includes a first member 300 and a second member 302. The first radial member 300 includes a base segment 304 have a first end 306, an opposing second end 308 and a middle section 310 extending therebetween. A first radial member 312 is connected to the middle section 310. The first end 306 and a portion of the middle section 310 include a plurality projections 314. In the illustrated embodiment, the projections 314 have the form of barbs. However, in other embodiments, the projections 314 can have other forms.

Referring again to FIGS. 14 and 15, the second member 302 includes opposing arms 316*a*, 316*b* arranged in a substantially parallel orientation. An inside surface of each of the opposing arms 316*a*, 316*b* includes a plurality of projections 318. The projections 318 are configured to receive and engage the projections 314 extending from the first radial member 300 in a manner such as to secure the first and second members 300, 300 together. In the illustrated embodiment, the projections 318 have the form of barbs. However, in other embodiments, the projections 318 can have other forms.

Referring again to FIGS. 14 and 15, the second member 302 includes a second radial member 320. An angled spline 322 extends from the second radial member 320 in a direction toward the first radial member 312. In operation, the first end 306 of the first member 300 is inserted into a gap formed between the opposing arms 316*a*, 316*b* until a resulting distance da1 formed between the first and second radial splines 312, 320 approximates the thickness of one of the sides of the three-sided envelope, thereby facilitating the resilient clamping action of the angled spline 322. In this orientation, the plurality of barbs 314 of the first member 300 and the plurality of barbs 318 of the second member engage each other in a manner such that the first and second members 300, 302 in a manner such as to secure the first and second members 300, 300 together. It should be appreciated that the distance da1 advantageously can vary as the thickness of one of the sides of the three-sided envelope vary.

Figure 16:
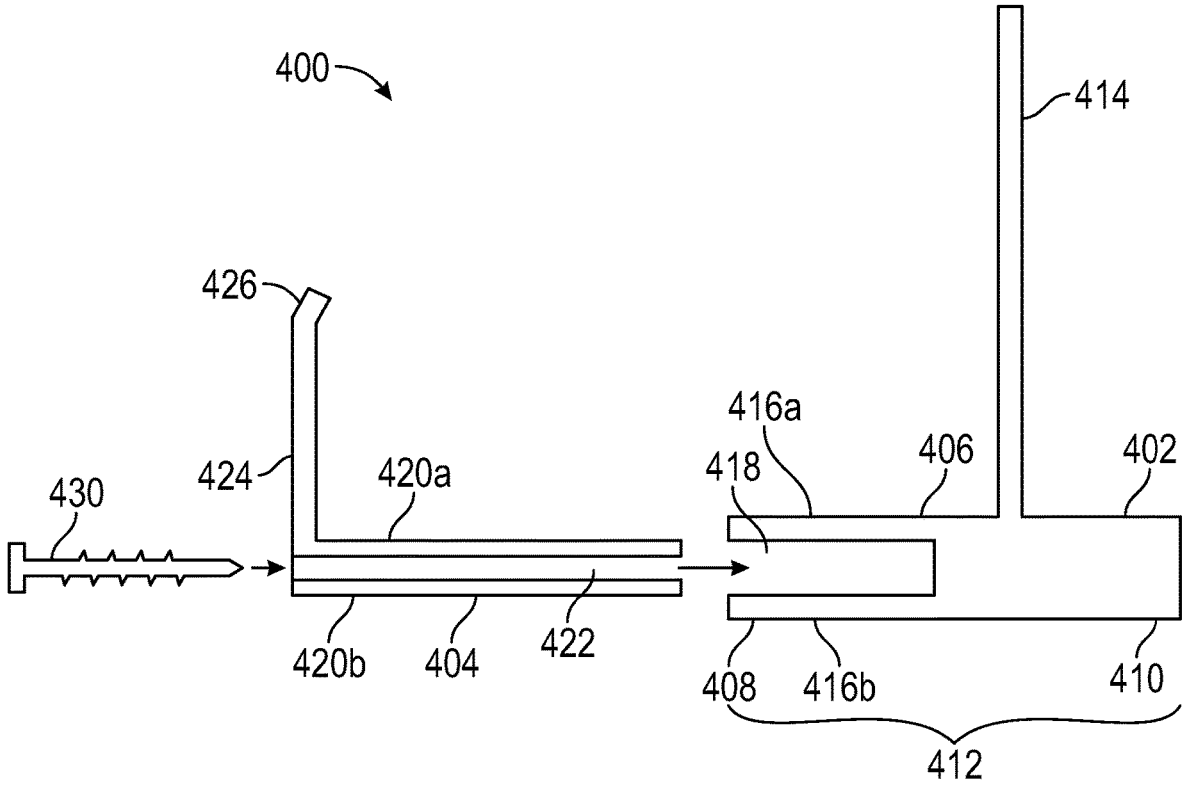
FIG. 16 is an exploded end view of a second embodiment of an adjustable fastening channel in accordance with the invention.
Figure 17:
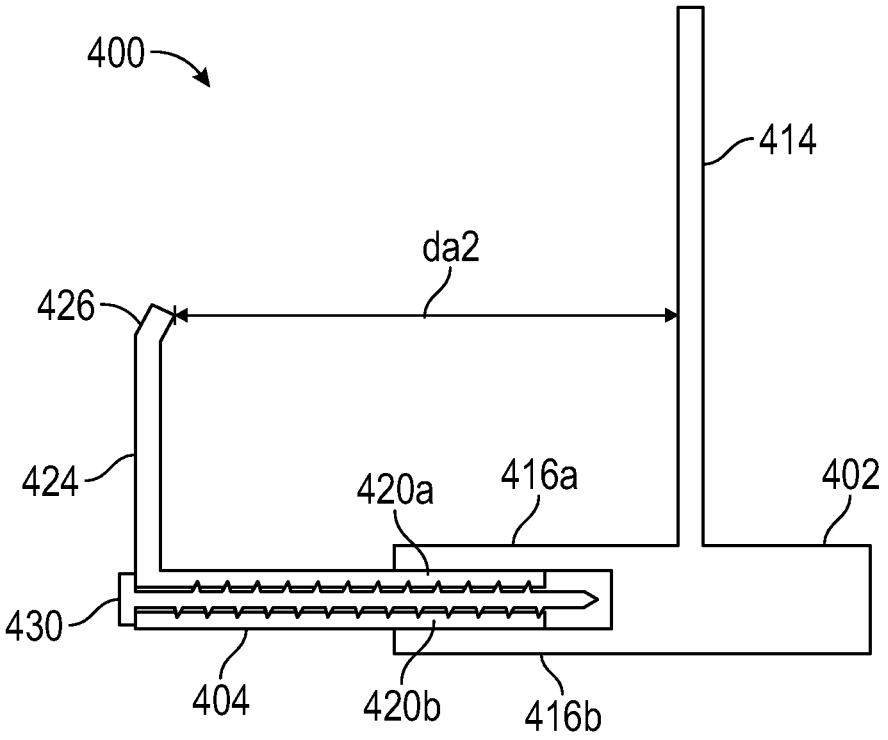
FIG. 17 is an assembled end view of the adjustable fastening channel of FIG. 16.

It should also be appreciated that an adjustable fastening channel can have different forms. Referring now to FIGS. 16 and 17, another embodiment of an adjustable channel is shown generally at 400. The fastening channel 400 includes a first member 402 and a second member 404. The first member 402 includes a base segment 406 have a first end 408, an opposing second end 410 and a middle section 412 extending therebetween. A first radial member 414 is connected to the middle section 412. The first end 408 and a portion of the middle section 412 include opposing arms 416*a*, 416*b*. The opposing arms 416*a*, 416*b* form a first internal cavity 418. As will be explained in more detail below, the first internal cavity 418 is configured to receive a portion of the second member 404.

Referring again to FIGS. 16 and 17, the second member 404 includes opposing arms 420*a*, 420*b* arranged in a substantially parallel orientation. The opposing arms 420*a*, 420*b* form a second internal cavity 422. The second member 404 further includes a second radial member 424. An angled spline 426 extends from the second radial member 424 in a direction toward the first radial member 414. In operation, the opposing arms 420*a*, 420*b* of the second member 404 are inserted into the first internal cavity 418 formed between the opposing arms 416*a*, 416*b* of the first member 402 until a resulting distance da2 is formed between the first and second radial splines 414, 424 approximates the thickness of one of the sides of the three-sided envelope, thereby facilitating the resilient clamping action of the angled spline 426. The engaged orientation of the first and second members 402, 404 is maintained through insertion of a fastener 430 into second internal cavity 422 formed between the opposing arms 420*a*, 420*b* of the second member 404. The combination of the insertion of the opposing arms 420*a*, 420*b* of the second member 404 into the first internal cavity 418 of the first member 402 and insertion of the fastener 420 into the second internal cavity 422 serves to secure the first and second members 402, 404 together. It should be appreciated that the distance da2 advantageously can vary as the thickness of one of the sides of the three-sided envelope vary.

Figure 18:
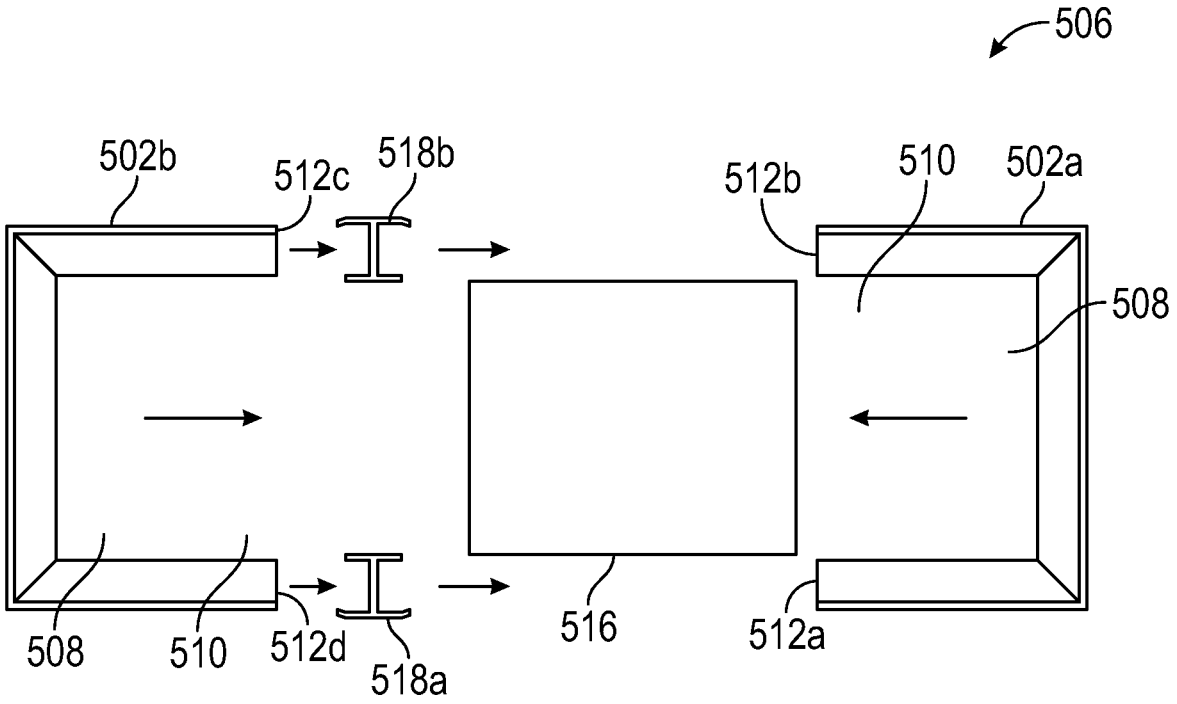
FIG. 18 is an end view of duct boards formed into opposing three-sided insulation envelopes, illustrating a cavity within the opposing three-sided insulation envelopes and configured to receive a section of uninsulated ductwork.
Figure 20:
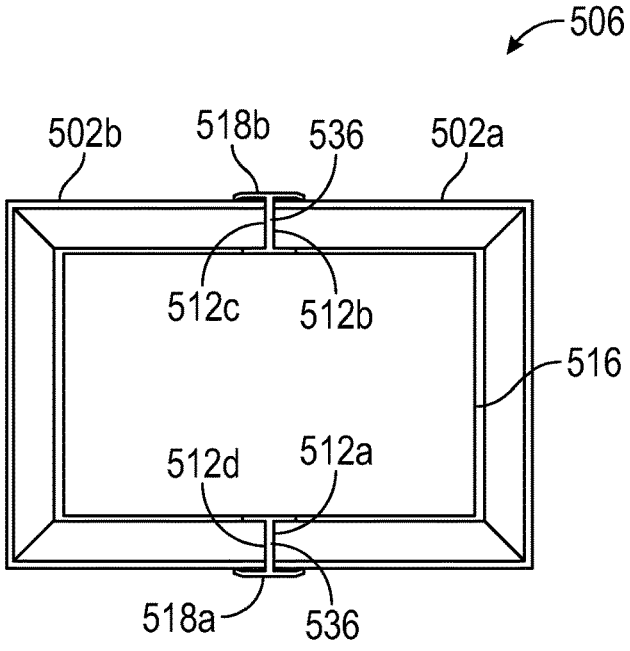
FIG. 20 is an end view of an uninsulated ductwork positioned within the opposing three-sided insulation envelopes of FIG. 18 and secured by the fastening channels of FIG. 19.

It is contemplated that in certain instances the section of uninsulated ductwork can have a cross-sectional area that is too large for the insulation assembly 92 shown in FIG. 10. In these instances, an insulation assembly can be formed from other structures. Referring now to FIGS. 18 and 20, a plurality of three-sided envelopes 502*a*, 502*b* can be used to form an insulation assembly 506. In the illustrated embodiment, the three-sided envelopes 502*a*, 502*b* are the same as, or similar to, the three-sided envelope 80 shown in FIG. 6 and described above. However, it should be appreciated that in other embodiments, the three-sided envelopes 502*a*, 502*b* can be different from the three-sided envelope 80. Each of the three-sided envelopes 502*a*, 502*b* includes an internal cavity 508 formed therewithin and an opening 510. The internal cavities 508 have rectangular or square cross-sectional shapes corresponding to the rectangular or square cross-sectional shape of an intended ductwork to be insulated. The cavities 508 have a length and height corresponding to length and height of the intended ductwork.

Referring again to FIGS. 18 and 20, edges 512*a*-512*d* of the three-sided envelopes 502*a*, 502*b* have square cross-sectional shapes, similar to the edges 86 of the insulation cap 84 shown in FIG. 9. The method of forming the insulation assembly 506 from the three-sided envelopes 502*a*, 502*b* includes the steps of placing the three-sided insulation envelopes 502*a*, 502*b* around a section 516 of uninsulated ductwork with a first fastening channel 518*a* positioned between mating edges 512*a* and 512*d* and a second fastening channel 518*b* positioned between mating edges 512*b* and 512*c*. In this manner, the ductwork section 516 seats within the cavities 508, the edges 512*a*, 512*d* seat against the fastening channel 518*a* and the edges 512*b*, 512*c* seat against the fastening channel 518*b*. Taken together, the three-sided insulation envelopes 502*a*, 502*b* and the fastening channels 518*a*, 518*b* form the insulation assembly 506, as shown in FIG. 20.

Figure 19:
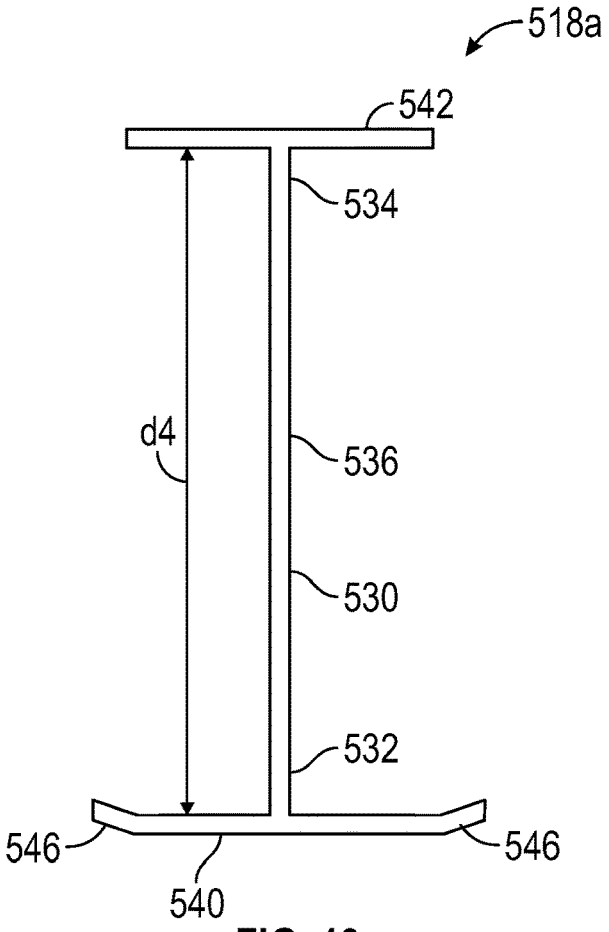
FIG. 19 is an end view of another embodiment of a fastening channel in accordance with the invention.

Referring now to FIG. 19, the fastening channel 518*a* is illustrated. The fastening channel 518*a* is representative of the fastening channel 518*b*. The fastening channel 518*b* is configured to receive portions of the three-sided insulation envelopes 502*a*, 502*b* in a manner such as to secure the three-sided insulation envelopes to the ductwork section 516. The fastening channel 518*a* includes a base segment 530 having a first end 532, an opposing second end 534 and a middle section 536 extending therebetween. An exterior member 540 extends from the first end 532 and an interior member 542 extends from the second end 534. The exterior and interior members 540, 542 are arranged in a substantially parallel orientation. Angled splines 546 extend from opposing ends of the exterior member 540. A distance d4 is formed between the exterior and interior members 540, 542.

Referring again to FIG. 20, the fastening channel 518*a* is shown in an installed orientation with the middle section 536 extending into a gap formed between the edges 512*a*-512*d* of the opposing three-sided insulation envelopes 502*a*, 502*b*. In the installed orientation, the interior member 542 seats against interior surfaces of the opposing three-sided insulation envelopes 502*a*, 502*b*. Further in the installed orientation, the exterior member 540 abuts opposing exterior surfaces of the opposing three-sided insulation envelopes 502*a*, 502*b*. In this position, the angled splines 546 press against an exterior surface of the three-sided envelopes 502*a*, 502*b*, thereby providing a resilient clamping action that attaches and maintains the three-sided envelopes 502*a*, 502*b* and the fastening channel 518*a* in place.

Referring now to FIG. 19, the distance d4 formed between the exterior and interior members 540, 542 approximates the thickness of the sides of the three-sided envelopes 502*a*, 502*b*, thereby facilitating the resilient clamping action of the angled spline 546.

Referring again to the embodiment illustrated in FIG. 19, the fastening channel 518*a* has the form of a unitary, one-piece structure and can be formed from the same or similar materials used to form the fastening channel 90*a*, shown in FIG. 11 and described above. However, it should be appreciated that in other embodiments, the fastening channel 518*a* can be formed from describe components that are attached together.

Figure 21:
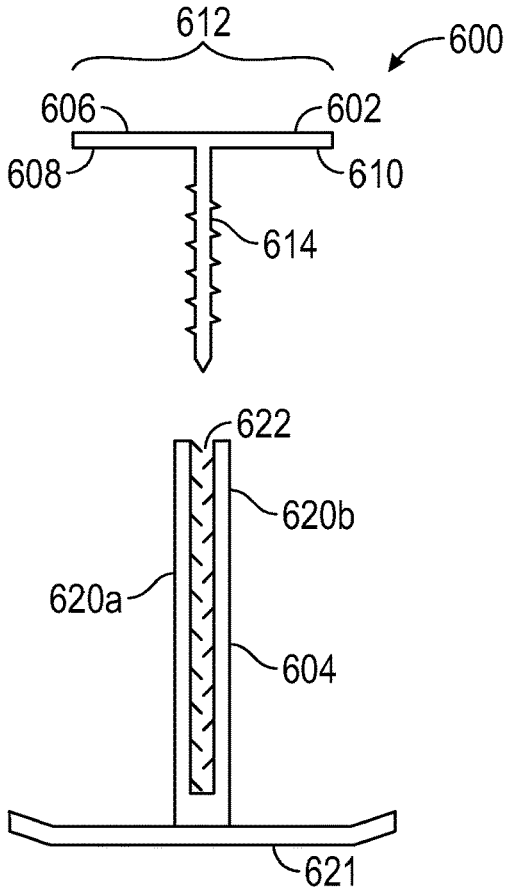
FIG. 21 is an exploded end view of another embodiment of an adjustable fastening channel in accordance with the invention.
Figure 22:
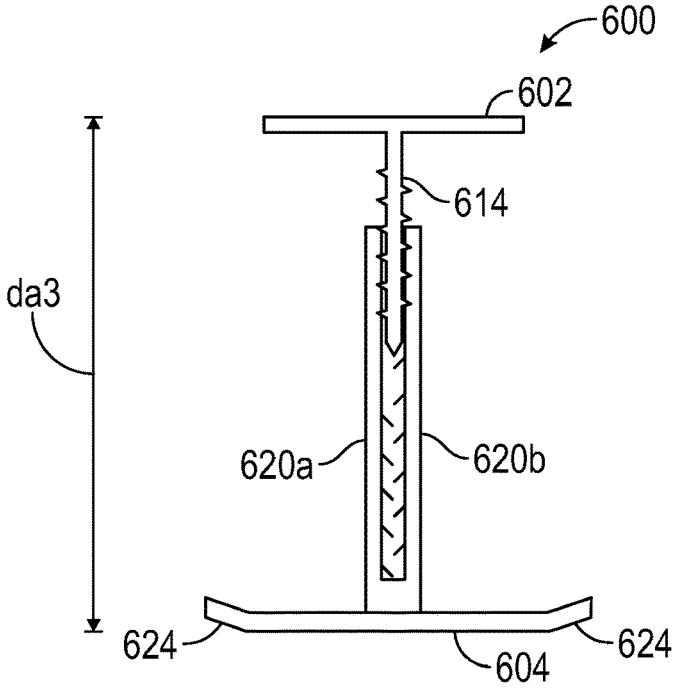
FIG. 22 is an assembled end view of the adjustable fastening channel of FIG. 21.

While the fastening channel 518*a* shown in FIG. 19 forms a fixed distance d4 between the exterior and interior members 540, 542, it is contemplated that in other embodiments portions of the fastening channel can be adjustable to accommodate sides of the opposing three-sided envelopes having different thicknesses. Referring now to FIGS. 21 and 22, another embodiment of a fastening channel is shown generally at 600. The fastening channel 600 includes a first member 602 and a second member 604. The first radial member 602 includes an interior base segment 606 have a first end 608, an opposing second end 610 and a middle section 612 extending therebetween. An extension member 614 is connected to the middle section 612. The extension member 614 includes a plurality of projections 616. In the illustrated embodiment, the projections 616 have the form of barbs. However, in other embodiments, the projections 616 can have other forms.

Referring again to FIGS. 21 and 2, the second member 604 includes opposing arms 620*a*, 620*b* arranged in a substantially parallel orientation and extending from an exterior base segment 621. An inside surface of each of the opposing arms 620*a*, 620*b* includes a plurality of projections 622. The projections 622 are configured to receive and engage the projections 614 extending from the first member 602 in a manner such as to secure the first and second members 602, 604 together. In the illustrated embodiment, the projections 622 have the form of barbs. However, in other embodiments, the projections 622 can have other forms sufficient to secure the first and second members 602, 604 together.

Referring again to FIGS. 21 and 22, the exterior base member 320 includes opposing angled splines 624 extending in a direction toward the interior base segment 606. In operation, the extension member 614 of the first member 602 is inserted into a gap formed between the opposing arms 620*a*, 620*b* until a resulting distance da3 formed between the interior and exterior base segments 606, 621 approximates the thickness of the sides of the three-sided envelopes 502*a*, 502*b*, thereby facilitating the resilient clamping action of the angled splines 624 as discussed above. In this orientation, the plurality of barbs 622 of the extension member 614 and the plurality of barbs within the opposing arms 620*a*, 620*b* of the second member 604 engage each other in a manner such that the first and second members 300, 302 are secured together. It should be appreciated that the distance da3 advantageously can vary as the thickness of the sides of the three-sided envelopes vary.

Figure 23:
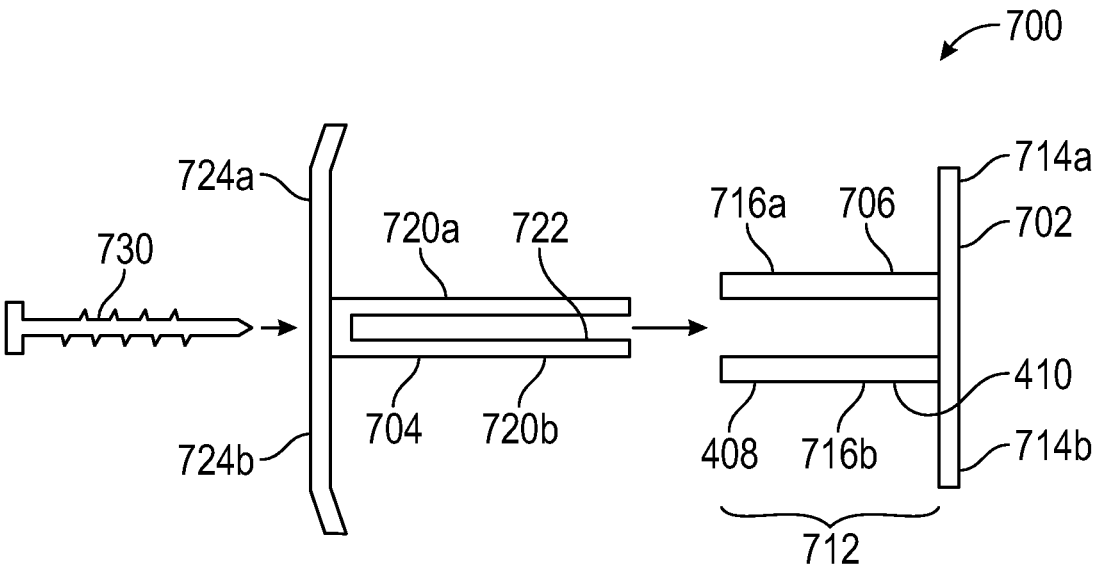
FIG. 23 is an exploded end view of another embodiment of an adjustable fastening channel in accordance with the invention.
Figure 24:
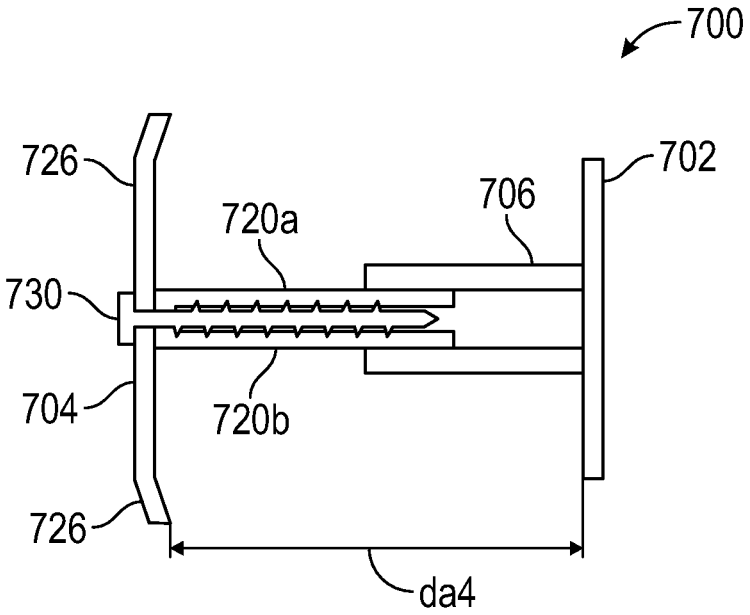
FIG. 24 is an assembled end view of the adjustable fastening channel of FIG. 23.

As noted above, it should also be appreciated that an adjustable fastening channel can have different forms. Referring now to FIGS. 23 and 24, another embodiment of an adjustable channel is shown generally at 700. The fastening channel 700 includes a first member 702 and a second member 704. The first member 702 includes a base segment 706 have a first end 708, an opposing second end 710 and a middle section 712 extending therebetween. Opposing radial members 714*a*, 714*b* extend from and are connected to the second end 710. The first end 708 and a portion of the middle section 712 include opposing arms 716*a*, 716*b*. The opposing arms 716*a*, 716*b* form a first internal cavity 718. As will be explained in more detail below, the first internal cavity 718 is configured to receive a portion of the second member 704.

Referring again to FIGS. 23 and 24, the second member 704 includes opposing arms 720*a*, 720*b* arranged in a substantially parallel orientation. The opposing arms 420*a*, 420*b* form a second internal cavity 722. The second member 704 further includes opposing radial members 724*a*, 724*b*. Angled splines 726 extend from the opposing radial members 724*a*, 724*b* in a direction toward the first member 702. In operation, the opposing arms 720*a*, 720*b* of the second member 704 are inserted into the first internal cavity 718 formed between the opposing arms 716*a*, 716*b* of the first member 402 until a resulting distance da4 is formed between the base segment 706 and the opposing radial members 724*a*, 724*b* approximates the thickness of one of the sides of the three-sided envelope, thereby facilitating the resilient clamping action of the angled splines 726. The engaged orientation of the first and second members 702, 704 is maintained through insertion of a fastener 730 into second internal cavity 722 formed between the opposing arms 720*a*, 720*b* of the second member 704. The combination of the insertion of the opposing arms 720*a*, 720*b* of the second member 704 into the first internal cavity 718 of the first member 702 and insertion of the fastener 720 into the second internal cavity 722 serves to secure the first and second members 702, 704 together. It should be appreciated that the distance da4 advantageously can vary as the thickness of one of the sides of the three-sided envelope vary.

Figure 25:
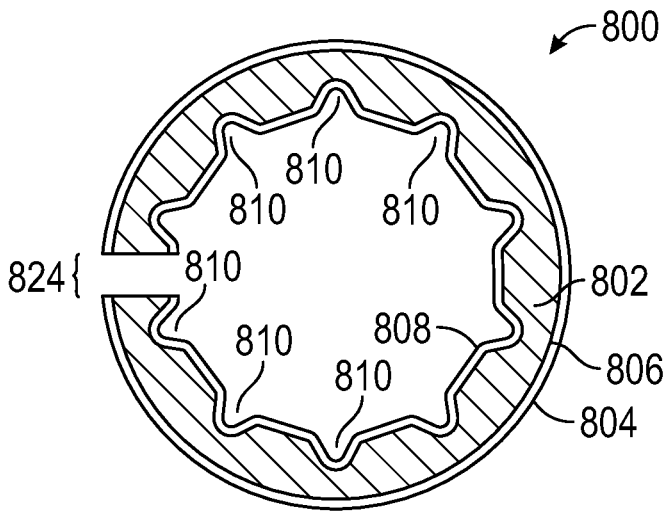
FIG. 25 is an end view of a duct board formed into a circular insulation envelope.

While the embodiment of the insulation assembly 92 shown in FIG. 10 are intended for uninsulated ductwork having a rectangular or square cross-sectional shape, it is contemplated that an insulation assembly can be formed for uninsulated ductwork have a circular cross-sectional shape. Referring now to FIG. 25, an alternate duct board according to the present invention is indicated generally at 800. The duct board 800 includes a layered foam insulation panel 802, a sheet of thermoplastic polymer 804 and opposing facing sheets 806 and 808. In the illustrated embodiment, the layered foam insulation panel 802, the sheet of thermoplastic polymer 804 and opposing facing sheets 806 and 808 are the same as, or similar to, the layer of foam insulation panel 62, a sheet of thermoplastic polymer 64 and opposing facing sheets 66 and 68 shown in FIGS. 3 and 4 and described above. However, it should be appreciated that in other embodiments, the layer of foam insulation panel 802, the sheet of thermoplastic polymer 804 and opposing facing sheets 806 and 808 can be different from the layer of foam insulation panel 62, a sheet of thermoplastic polymer 64 and opposing facing sheets 66 and 68.

Referring again to FIG. 25, a plurality of V-shaped grooves, indicated at 810, have been formed in the duct board 800 in a manner such as to allow the duct board 800 to be bent into an arcuate shape.

Figure 26:
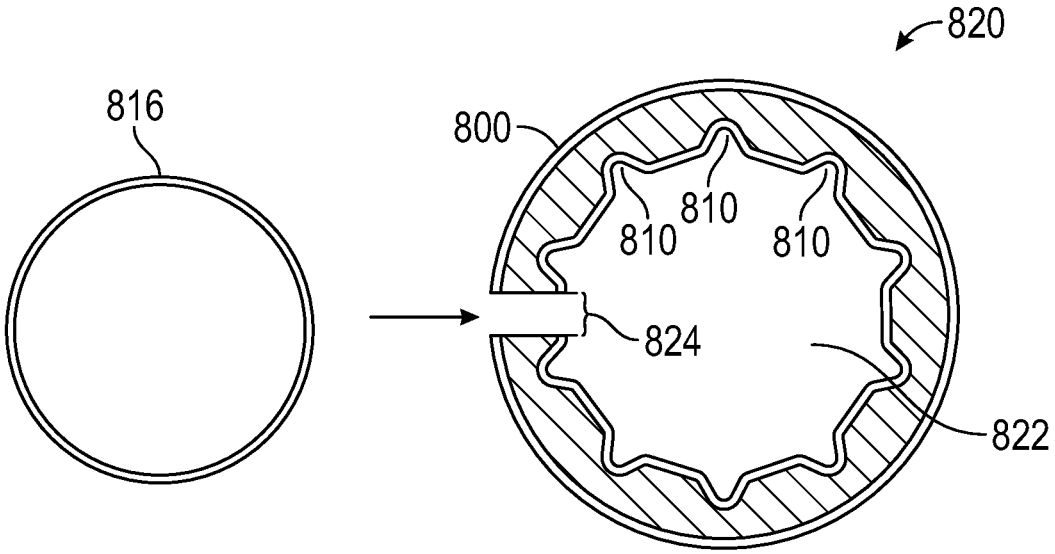
FIG. 26 is an end view of the circular insulation envelope of FIG. 25 configured to enclose a circular section of uninsulated ductwork.
Figure 27:
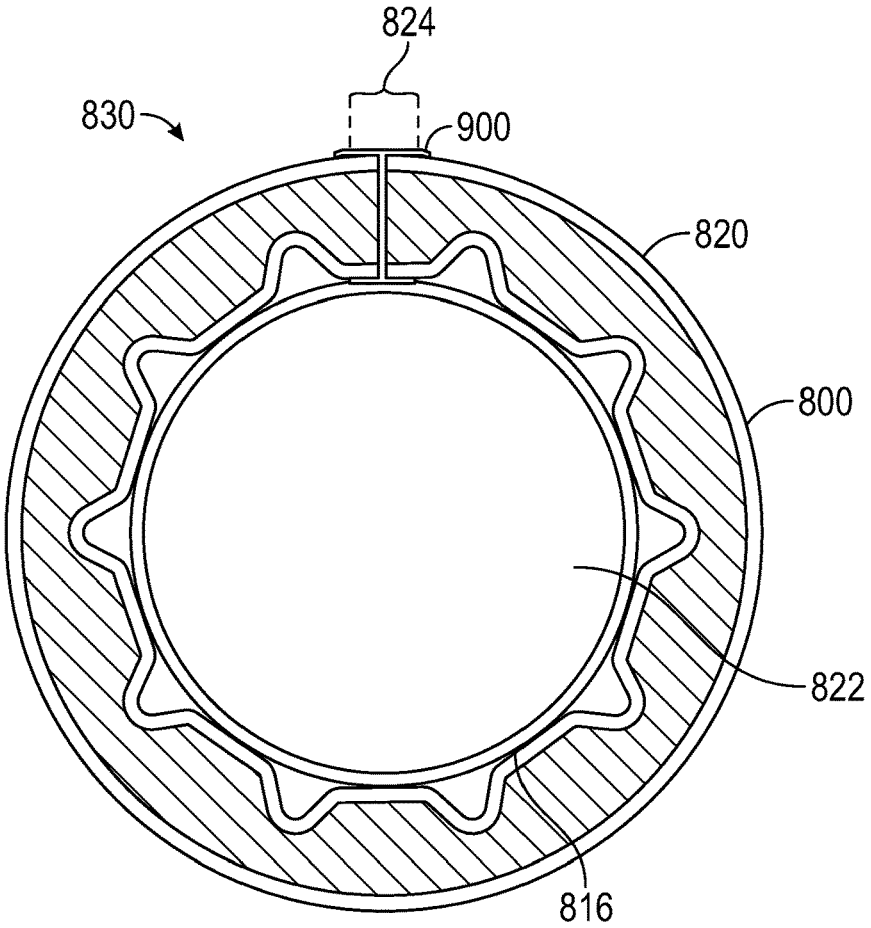
FIG. 27 is an insulation assembly formed by the circular insulation envelope of FIG. 25 and a fastening channel.

Referring now to FIGS. 26 and 27, the method of forming the duct board 800 into an insulating assembly will now be discussed. Referring initially to FIG. 26 in first step, the duct board 800 is folded along the plurality of V-shaped grooves 810 until the duct board 800 has the arcuate or circular cross-sectional shape, thereby forming a circular insulation envelope 820. The circular insulation envelope 820 forms a cavity 822 therewithin and an opening 824. The cavity 822 has a circular cross-sectional shape corresponding to the circular cross-sectional shape of an intended ductwork to be insulated. The cavity 822 has a diameter corresponding to the diameter of the intended ductwork.

Referring again to FIG. 26 in a next step, the circular insulation envelope 820 is installed on a section 816 of uninsulated ductwork by extending the opening 824 of the circular insulation envelope 820 in a manner such that the circular insulation envelope 820 can be positioned within the cavity 822.

Referring now to FIG. 27, the circular insulation envelope 820 is shown encapsulating the section 816 with the section 816 positioned within the cavity 822. The opposing portions of the circular insulation envelope 820 adjacent the opening 824 form edges having square cross-sectional shapes, similar to the edges 86 of the insulation cap 84 shown in FIG. 9. A fastening channel 900 is positioned between mating edges of the opposing portions of the circular insulation envelope 820. In this manner, the ductwork section 816 seats within the cavity 822 and the mating edges seat within the fastening channel 900. Taken together, the circular insulation envelopes 820 and the fastening channel 900 form the insulation assembly 830.

Figure 28:
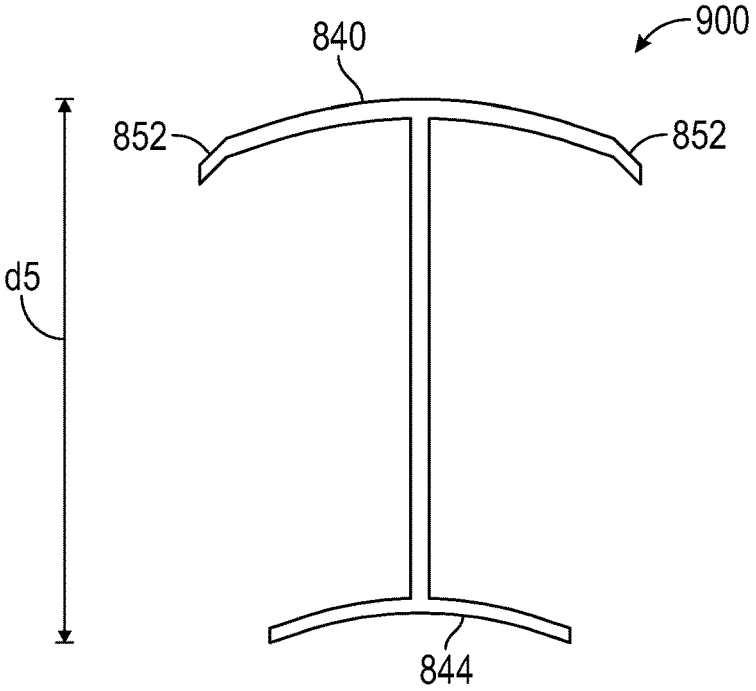
FIG. 28 is an end view of the fastening channel of FIG. 27.

Referring now to FIG. 28, the fastening channel 900 is illustrated. The fastening channel 900 is configured to receive portions of the circular insulation envelope 820 in a manner such as to secure the circular insulation envelope 820 to the ductwork section 816. The fastening channel 900 is similar in form to the fastening channel 518*a* illustrated in FIG. 19 and described above with the exceptions that an exterior member 840 has an arcuate cross-sectional shape that approximates an arcuate cross-sectional shape of the outer surface of the circular insulation envelope 820, an interior member 844 has an arcuate cross-sectional shape that approximates an arcuate cross-sectional shape of the ductwork section 816 and the arcuate exterior member 840 includes opposing angled splines 852. The arcuate cross-sectional shapes of the exterior and interior members 840, 844 are configured to facilitate a close fit of the circular insulation envelope 820 with the ductwork section 816. The angled splines 852 are angled in a direction toward the arcuate interior member 844.

Referring again to FIG. 27, in the assembled position, the angled splines 852 press against an exterior surface of the circular insulation envelope 820, thereby providing a resilient clamping action that attaches and maintains the circular envelope 820 and the fastening channel 900 in place.

Referring again to FIG. 28, a distance d5 is formed between the exterior and interior members 840, 844. The distance d5 approximates the thickness of the sides of the circular envelope 820, thereby facilitating the resilient clamping action of the angled spline 852.

Figure 29:
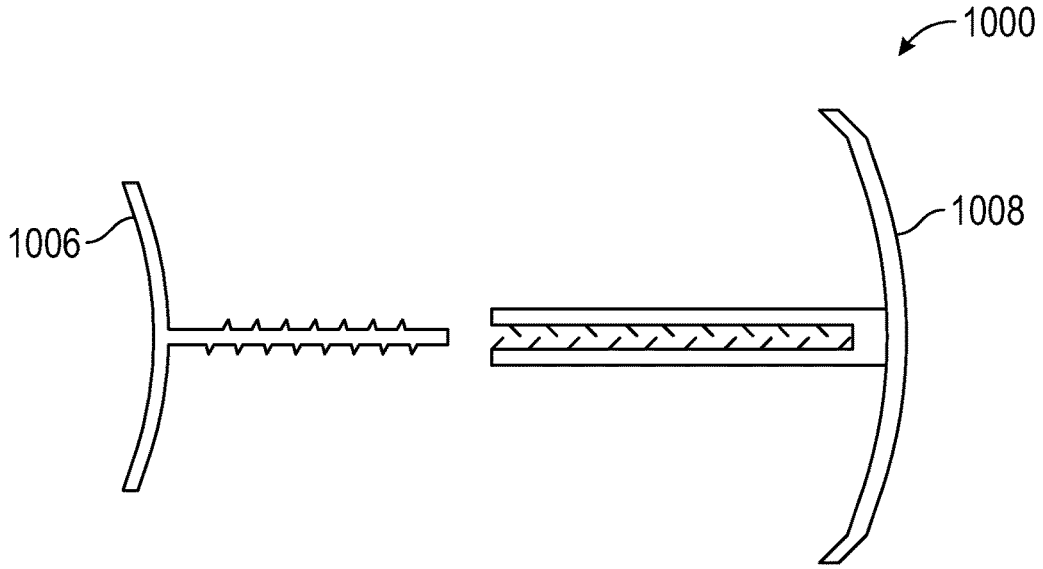
FIG. 29 is another embodiment of an adjustable fastening channel.
Figure 30:
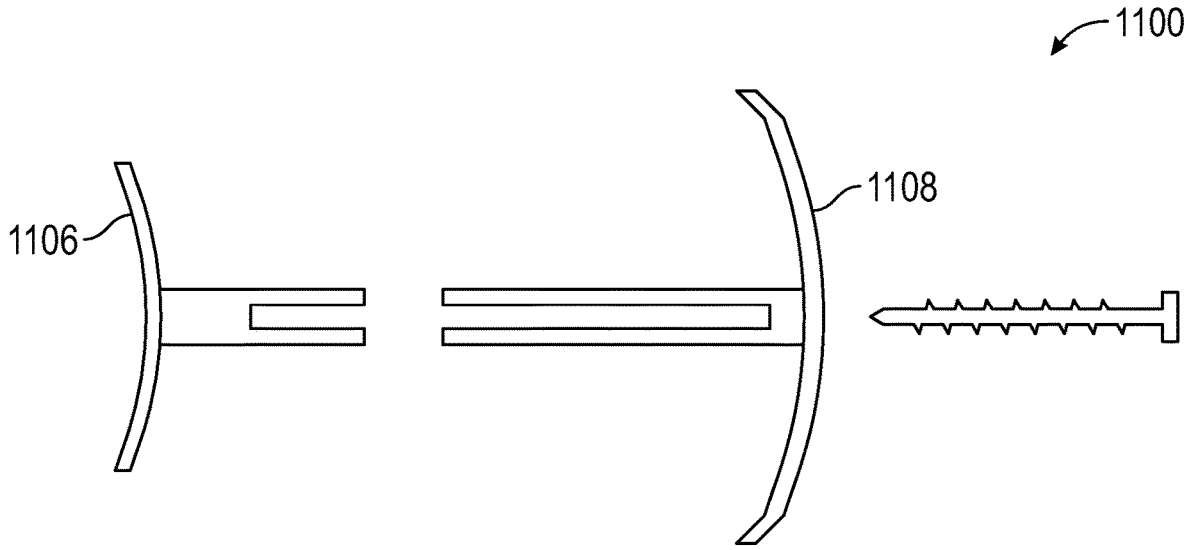
FIG. 30 is another embodiment of an adjustable fastening channel.

While the fastening channel 900 shown in FIG. 28 forms a fixed distance d5 between the exterior and interior members 840, 844, it is contemplated that in other embodiments portions of the fastening channel can be adjustable to accommodate sides of the opposing circular insulation envelopes having different thicknesses. Referring now to FIGS. 29 and 30, alternate embodiments of an adjustable fastening channel configured for circular insulation envelopes are shown. Referring first to FIG. 29, an adjustable fastening channel 1000 is illustrated. The adjustable channel 1000 is the same as the fastening channel 600 shown in FIGS. 21 and 22 with the exceptions that the interior base segment 1006 has an arcuate cross-sectional shape and the exterior base segment 1008 also has an arcuate cross-sectional shape. The installation, assembly and function of the fastening channel 1000 is the same as that described above for the fastening channel 600.

Referring now to FIG. 30, another embodiment of an adjustable fastening channel is shown generally at 1100. The adjustable channel 1100 is the same as the fastening channel 700 shown in FIGS. 23 and 24 with the exceptions that the interior base segment 1106 has an arcuate cross-sectional shape and the exterior base segment 1108 also has an arcuate cross-sectional shape. The installation, assembly and function of the fastening channel 1100 is the same as that described above for the fastening channel 700.

The fastening channels provide many benefits, although not all benefits may be available in all embodiments. First, the fastening channels advantageously facilitate easy insulation of uninsulated ductwork without disruption of the uninsulated ductwork. Second, the fastening channels advantageously facilitate insulation of uninsulated ductwork without disruption of the air flowing through the uninsulated ductwork. Third, the fastening channels seal seams formed in the insulation envelopes. Fourth, the fastening channels are configured for uninsulated ductwork having rectangular or circular cross-sectional shapes.

In accordance with the provisions of the patent statutes, the principle and mode of operation of the insulation fastening systems have been explained and illustrated in certain embodiments. However, it must be understood that the insulation fastening systems may be practiced otherwise than as specifically explained and illustrated without departing from its spirit or scope.

What is claimed is:

1. An insulation assembly comprising:

an insulation envelope configured to form a cavity, the cavity configured to receive a section of uninsulated ductwork, the insulation envelope formed from a duct board and having first and second side members, an abutting upper member and an opposing and abutting insulation cap, the duct board formed from a thermoplastic polymer sheet, a plurality of facing sheets and a layer of foam insulation, the insulation envelope forming an opening;

a fastening channel positioned within the opening of the insulation envelope and having first and second members, each extending from a common base and cooperating to form one or more cavities, the first member of the fastening channel positioned between an end of the abutting insulation cap and an inside surface of the first side member and the second member positioned adjacent an outer surface of the first side member, the base member having contact with an outer surface of the insulation cap, the cavities configured to receive sections of the insulation envelope, the fastening channel also having an angled spline extending from the second member and forming a clamp, the clamp configured to engage the outer surface of the first side member so as to maintain the insulation envelope in place, the first member having a first member length that extends from the common base to a distal end, the first member having a constant cross-section along its length, the second member having a second member length that extends from the common base member to the angled spline, the second member length having a constant cross-section along its length, and one or more fasteners configured to extend through the base member and into a portion of the insulation envelope.

2. The insulation assembly of claim 1, wherein the cavity within insulation envelope has a rectangular cross-sectional shape.

3. The insulation assembly of claim 1, wherein the fastening channel is adjustable for use with insulation envelopes having different thicknesses.

4. The insulation assembly of claim 3, wherein the first and second members of the fastening channel have a distance therebetween that is fixed by a fastener.

5. The insulation assembly of claim 4, wherein the fastener is a plurality of barbs.

* * * * *